US010273724B2

(12) United States Patent
Yamagata et al.

(10) Patent No.: US 10,273,724 B2
(45) Date of Patent: Apr. 30, 2019

(54) DOOR LOCK DEVICE

(71) Applicant: U-SHIN LTD., Tokyo (JP)

(72) Inventors: Mikio Yamagata, Hiroshima (JP); Tetsuya Shimosawa, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 827 days.

(21) Appl. No.: 14/741,904

(22) Filed: Jun. 17, 2015

(65) Prior Publication Data

US 2015/0368939 A1 Dec. 24, 2015

(30) Foreign Application Priority Data

Jun. 24, 2014 (JP) ..... 2014-129182

(51) Int. Cl.
*E05B 79/04* (2014.01)
*E05B 79/08* (2014.01)
*E05B 85/02* (2014.01)

(52) U.S. Cl.
CPC ..... *E05B 79/04* (2013.01); *E05B 79/08* (2013.01); *E05B 85/02* (2013.01); *Y10T 292/108* (2015.04)

(58) Field of Classification Search
CPC ..... E05B 79/08
USPC ..... 292/200, 201, 216
See application file for complete search history.

(56) References Cited

U.S. PATENT DOCUMENTS 6,042,160 A * 3/2000 Hamada ..... E05B 83/16 292/216
6,679,532 B2 * 1/2004 Inoue ..... E05L 81/06 292/201
7,156,430 B2 * 1/2007 Hidding ..... E05B 85/02 292/216
8,979,145 B2 * 3/2015 Yamagata ..... E05B 83/36 292/201
9,752,355 B2 * 9/2017 Nagaoka ..... E05B 79/08
2002/0167177 A1 * 11/2002 Erices ..... E05L 77/04 292/201
2006/0103146 A1 * 5/2006 Noel ..... E05B 85/02 292/216
2009/0218830 A1 9/2009 Yamagata

FOREIGN PATENT DOCUMENTS

DE 29716023 U1 * 11/1997 ..... E05B 79/08
DE 202012007325 U1 * 11/2013 ..... E05B 77/34
FR 2635137 A1 * 2/1990 ..... E05B 77/36
JP 2009-203738 9/2009
JP 2014-105471 6/2014
WO WO-2013137040 A1 * 9/2013 ..... E05B 9/08

* cited by examiner

*Primary Examiner* — Carlos Lugo
(74) *Attorney, Agent, or Firm* — Wenderoth, Lind & Ponack, L.L.P.

(57) ABSTRACT

A door lock device includes a latch mechanism which is releasably engaged with a striker and which has an operation receiving part for releasing engagement of the striker, a link movable between an unlock position where the engagement of the striker can be released and a lock position where the engagement cannot be released, and a lock plate for positioning the link into the unlock position or the lock position. A push lever 60, upon operation of the door handle, releases engagement of the striker by the latch mechanism 11 via the link 30 positioned in the unlock position and the operation receiving part 28. A bearing part 64 of the push lever 60 is rotatably supported by a bearing part 70 integrally formed in a main case 15.

5 Claims, 13 Drawing Sheets

DOOR LOCK DEVICE

CROSS-REFERENCE TO RELATED APPLICATION

This application claims priority of Japanese Patent Application No. 2014-129182 filed on Jun. 24, 2014, the content of which is incorporated herein by reference.

TECHNICAL FIELD

The present invention relates to a door lock device.

BACKGROUND

A door lock device for vehicles disclosed in JP 2009-203738 A includes a latch mechanism for releasably engaging a striker, and a link movable between an unlock position and a lock position. Operation of an outer handle provided on the vehicle-external side of the door is transmitted to the link via a push lever.

The push lever is coupled to the outer handle, for example, via a rod and moreover coupled to the link. The push lever is rotatable about a shaft, and the shaft is fixed by caulking to a fitting hole portion of a main case. Further, the push lever is elastically biased by a bias spring in such a direction that the link is separated apart from an operation receiving part of the latch mechanism.

As in the case of JP 2009-203738 A, with a shaft used for rotatably fitting the push lever to the main case, the following problems come up. Since the shaft, which is a member independent of the push lever and the main case, a number of parts is increased. Since a shaft caulking process is needed for fixing the shaft to the main case, and assembling man-hours are increased.

SUMMARY

Accordingly, an object of the present invention is to achieve a simplification of the fitting structure of the push lever to the main case in door lock devices.

An aspect of the present invention provides a door lock device includes a latch mechanism releasably engaged with a striker and having an operation receiving part for releasing engagement of the striker, a link movable between an unlock position and a lock position. The unlock position allows the link, to engage with the operation receiving part of the latch mechanism so that the engagement of the striker is able to be released. The lock position does not allow the link to engage with the operation receiving part of the latch mechanism so that the engagement of the striker is not able to be released. The door lock device further includes a lock plate for positioning the link into the unlock position or the lock position, a push lever having a shaft part, coupled to a door handle provided on a door, and configure to operate, upon operation of the door handle, so as to release engagement of the striker by the latch mechanism via the link positioned in the unlock position and the operation receiving part, and a main case in which a bearing part for rotatably supporting the shaft part of the push lever is formed integrally therewith.

In this door lock device, the shat part of the push lever is supported by the bearing part integrally formed in the main case. Accordingly, there is no need for providing a shaft independent of the main case to rotatably support the outer lever. Thus, a number parts can be reduced, so that the device structure can be simplified.

The door lock device may further include a restricting member contact with the main case. With this arrangement, there is no need to fix the shaft rotatably supporting the push lever to the main case by caulking of the shaft, resulting in reduced assembling man-hours and simplified assembling work.

The latch mechanism is attached to the main case. The restricting member is integrally formed in the latch mechanism so as to extend in an arm-like shape. The main case includes a first wall with the bearing part formed thereon, a second wall opposed to the first wall, and a communicating part defined between the first wall and the second wall, the communicating part being communicated with a component housing part in which the link are arranged so as to allow the push lever to be inserted into the component housing part. The shaft part of the push lever supported by the bearing part is retained between the first wall and the second wall via the restricting member. With these arrangements, since the restricting member is integrally formed in the latch mechanism, the shaft part of the outer lever 60 can be retained between the first wall and the second wall via the restricting member simultaneously while the latch mechanism is attached to the main case. Thus, the assembling man-hours can be reduced.

The bearing part of the main case includes a cylindrical-shaped inner shaft part protruding toward the second wall, and a cylindrical-shaped outer shaft part placed outside the inner shaft part and protruding toward the second wall. A recessed groove is formed between the inner shaft part and the outer shaft part. The shaft part of the push lever is a cylindrical-shaped shaft part to be fitted into the recessed groove. With this arrangement, the push lever is rotatably supported by being fitted into the recessed groove. Therefore, the push can be rotated smoothly and stably.

The cylindrical-shaped shaft part is formed integrally with the push lever by burring process. This allows that the cylindrical-shaped shaft part can be easily formed.

A protruding extent of the inner shaft part from the first wall is longer than a protruding extent of the outer shaft part from the first wall by an extent corresponding to a thickness of a portion of the push lever where the cylindrical-shaped shaft part is provided. With this arrangement, a portion of the push lever including the cylindrical-shaped shaft part can be pinched and retained between the outer shaft part and the restricting member, and thereby the leading end of the inner shaft part can be put into direct contact with the restricting member. Thus, the restricting member can be prevented from being brought into pressure contact against the push lever with excessively strong force, so that actuation of the push lever can be stabilized.

In the door lock device according to the invention, since the shaft part of the push lever is rotatably supported by the bearing part integrally formed in the main case, there is no need for providing a shaft independent of the main case. Therefore, the number of parts can be reduced, so that the device structure can be simplified. Further, since the shaft part of the push lever is retained between the bearing part and the restricting member without the need for caulking process of the shaft, the assembling man-hours are reduced and the assembling work can be simplified.

BRIEF DESCRIPTION OF THE DRAWINGS

The foregoing and the other features of the present invention will become apparent from the following description and drawings of an illustrative embodiment of the invention in which.

DESCRIPTION OF EMBODIMENTS

Hereinbelow, an embodiment of the present invention will be described with reference to the accompanying drawings.

Figure 1:
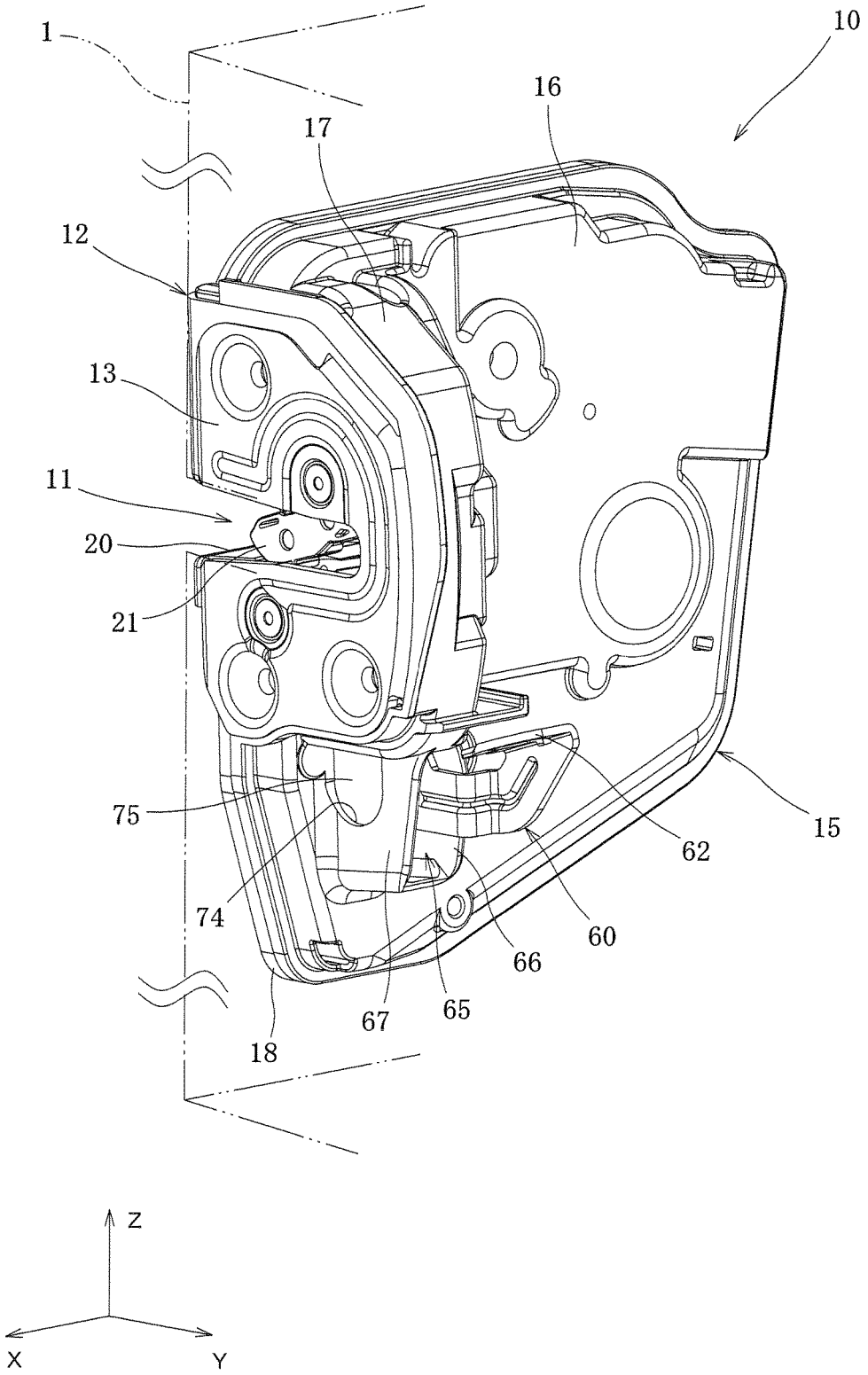
FIG. 1 is a perspective view seen from a side of a door lock device according to an embodiment of the present invention.
Figure 2:
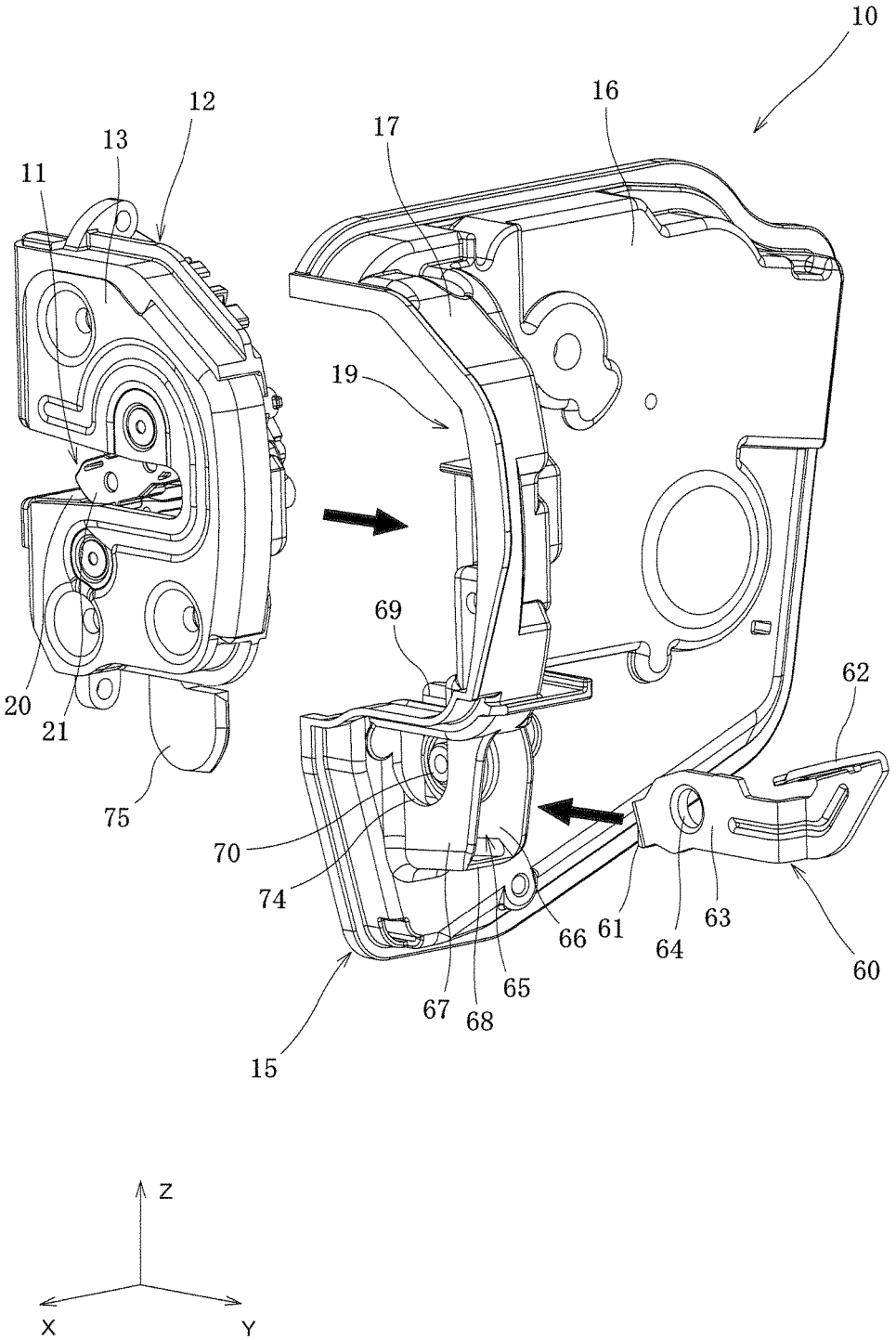
FIG. 2 is an exploded perspective view seen from the side of the door lock device according to the embodiment of the present invention.
Figure 3:
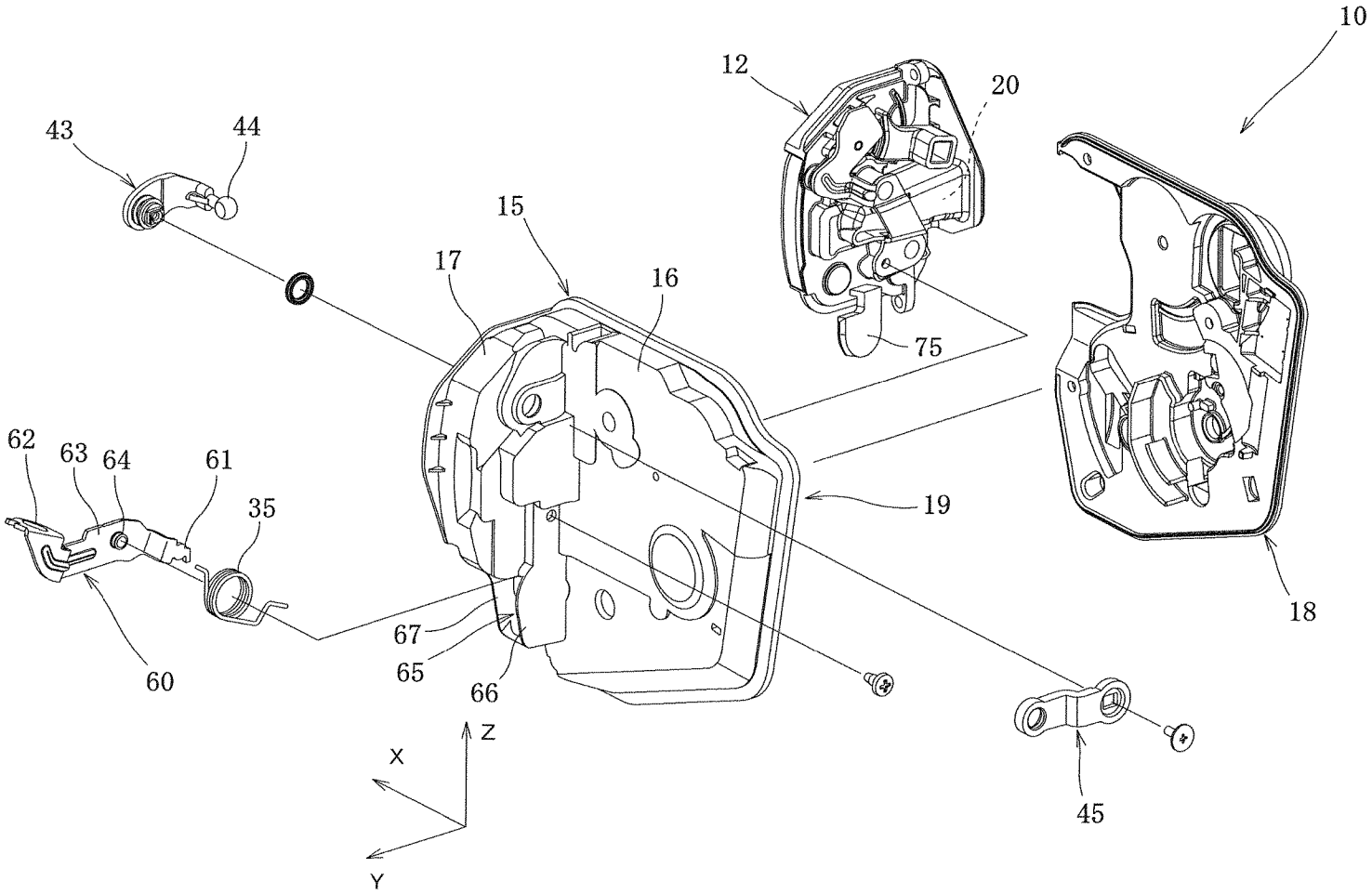
FIG. 3 is an exploded perspective view seen from a rear of the door lock device according to the embodiment of the present.

FIGS. 1 to 3 show a door lock device 10 according to an embodiment of the invention.

(Overall Construction)

As shown in FIG. 1, the door lock device 10 is mounted on an openable-and-closable door 1 (conceptually shown only in FIG. 1) of a vehicle. The door lock device 10 includes a latch mechanism 11 and a lock mechanism 14. The latch mechanism 11 is releasably engaged with a striker (not shown) fitted to the vehicle body. The lock mechanism 14 switches over between an unlock state, in which the engagement of the striker by the latch mechanism 11 can be released, and a lock state, in which the engagement of the striker by the latch mechanism 11 cannot be released.

The switchover of the lock mechanism 14 between the unlock state and the lock state is executed by operation of a lock knob (not shown) provided in the vehicle interior, operation of a key cylinder (not shown) using a key provided in the vehicle exterior, or drive of a motor 55. The drive of the motor 55 is executed by operation of a lock switch (not shown) mounted on the vehicle or operation of a locking/unlocking remote controller (not shown) carried by a user.

While the lock mechanism 14 is in the unlock state, the engagement of the striker by the latch mechanism 11 can be released by operation of the door handle (not shown) provided on the door 1, by which the door 1 can be opened. While the lock mechanism 14 is in the lock state, the engagement of the striker by the latch mechanism 11 cannot be released even by operation of the door handle, so that the door 1 cannot be opened. It is noted that the door handle has an inner handle provided on the vehicle interior side, and an outer handle provided on the vehicle exterior side.

The latch mechanism 11 includes a sub-case 12 made from resin, and a cover plate 13 made from metal. Various components for releasably engaging the striker including a fork 21 and a claw 25 are disposed in the sub-case 12.

The lock mechanism 14 includes a main case 15 and a cover 18 both made from resin. As most clearly shown in FIG. 3, the main case 15 includes a first case part 16 and a second case part 17. The first case part 16 is formed into a generally plate shape extending in an XZ plane in the figure, and the second case part 17 is formed into a generally plate shape extending in a YZ plane in the figure. The first case part 16 and the second case part 17 cross generally perpendicularly to each other on the forward-end outer surface side of the door 1. Various components for switching over between the unlock state and the lock state including a link 30 and a lock plate 36 are disposed in the first case part 16. These components are covered with the cover 18 fitted to the first case part 16. The interior of the first case part 16 covered with the cover 18 forms a component housing part 19 of the lock mechanism 14. The second case part 17 protrudes in a Y direction from one end of the first case part 16. The latch mechanism 11 (sub-case 12) is fitted to the second case part 17.

(Latch Mechanism)

Figure 4:
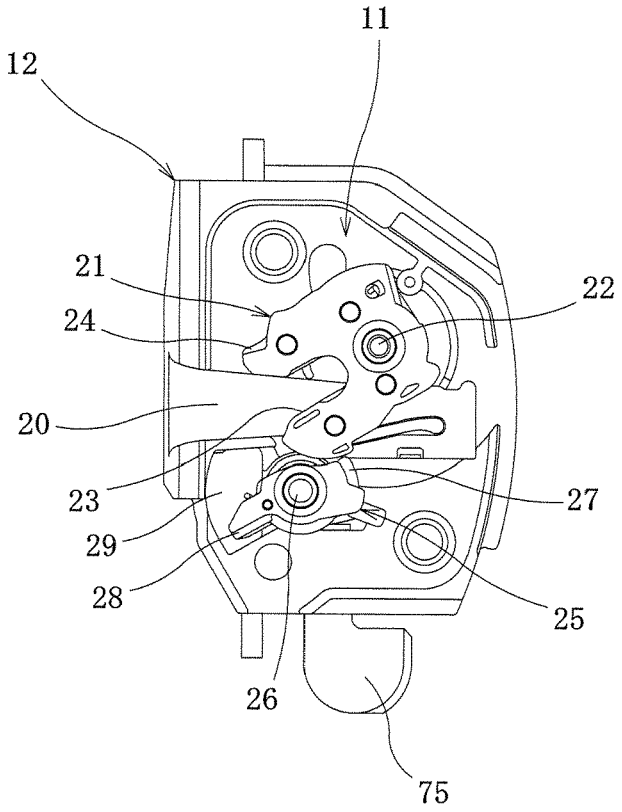
FIG. 4 is a front view of a latch mechanism.
Figure 4:
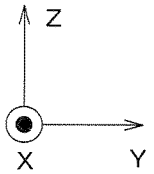

As shown in FIG. 4, in the sub-case 12 included in the latch mechanism 11, an insertion recess 20 for inserting the striker therethrough is provided so as to extend in the Y direction from vehicle exterior side to vehicle interior side. The fork 21 is placed on the upper side of the insertion recess 20, and the claw 25 is placed on the lower side of the insertion recess 20.

The fork 21 is rotatably supported by a fork rotating shaft 22. The fork 21 has an engaging recess 23 provided by an opening formed at a left end as in the figure. An engaging portion 24 is provided at an end on the side on which the engaging recess 23 is opened. The fork 21 is elastically biased by an unshown spring so that its rotational angle position around the fork rotating shaft 22 comes to the open position shown in FIG. 4. By the striker entering into the engaging recess 23, the fork 21 is rotated counterclockwise from the open position, resulting in a closed position in which the engaging recess 23 extends in a direction perpendicular to the insertion recess 20. The engagement of the striker by the fork 21 is released in the open position, and the striker is engaged by the fork 21 in the closed position. As the engagement of the engaging portion 24 is released in the state in which the fork 21 has been rotated to the closed position, the fork 21 is rotated to the open position by the spring.

The claw 25 is rotatably supported by a claw rotating shaft 26. The claw 25 has an engagement receiving part 27 provided on the right side of the claw rotating shaft 26. An operation receiving part 28 for releasing the engagement of the striker is provided on the left side of the claw rotating shaft 26. The operation receiving part 28 protrudes inward of the component housing part 19 of the main case 15 through an insertion hole 29 of the sub-case 12. The claw 25 is elastically biased by an spring (not shown) so that its rotational angle position around the claw rotating shaft 26 comes to an engagement position shown in FIG. 4. As the fork 21 is rotated to the closed position, the engagement receiving part 27 is engaged with the engaging portion 24 of the fork 21 while the claw 25 holds the fork 21 in the closed position. In this engagement state, as the operation receiving part 28 is moved (operated) upward in the figure, the claw 25 is rotated clockwise, so that the engagement between the engagement receiving part 27 and the engaging portion 24 is released. When the operation of the operation receiving part 28 is stopped, the claw 25 is rotated to the engagement position by the spring.

(Lock Mechanism)

Figure 5A:
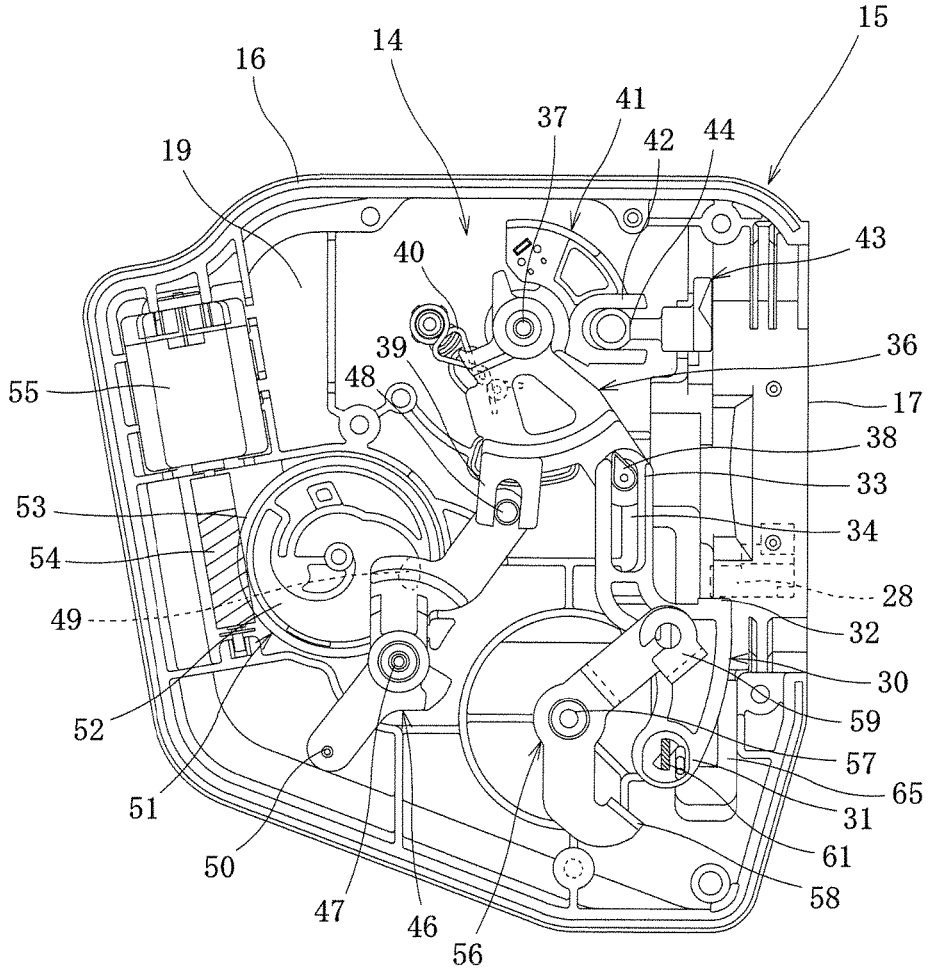
FIG. 5A is a front view of a lock mechanism in an unlock state.
Figure 5A:
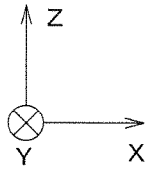
Figure 5B:
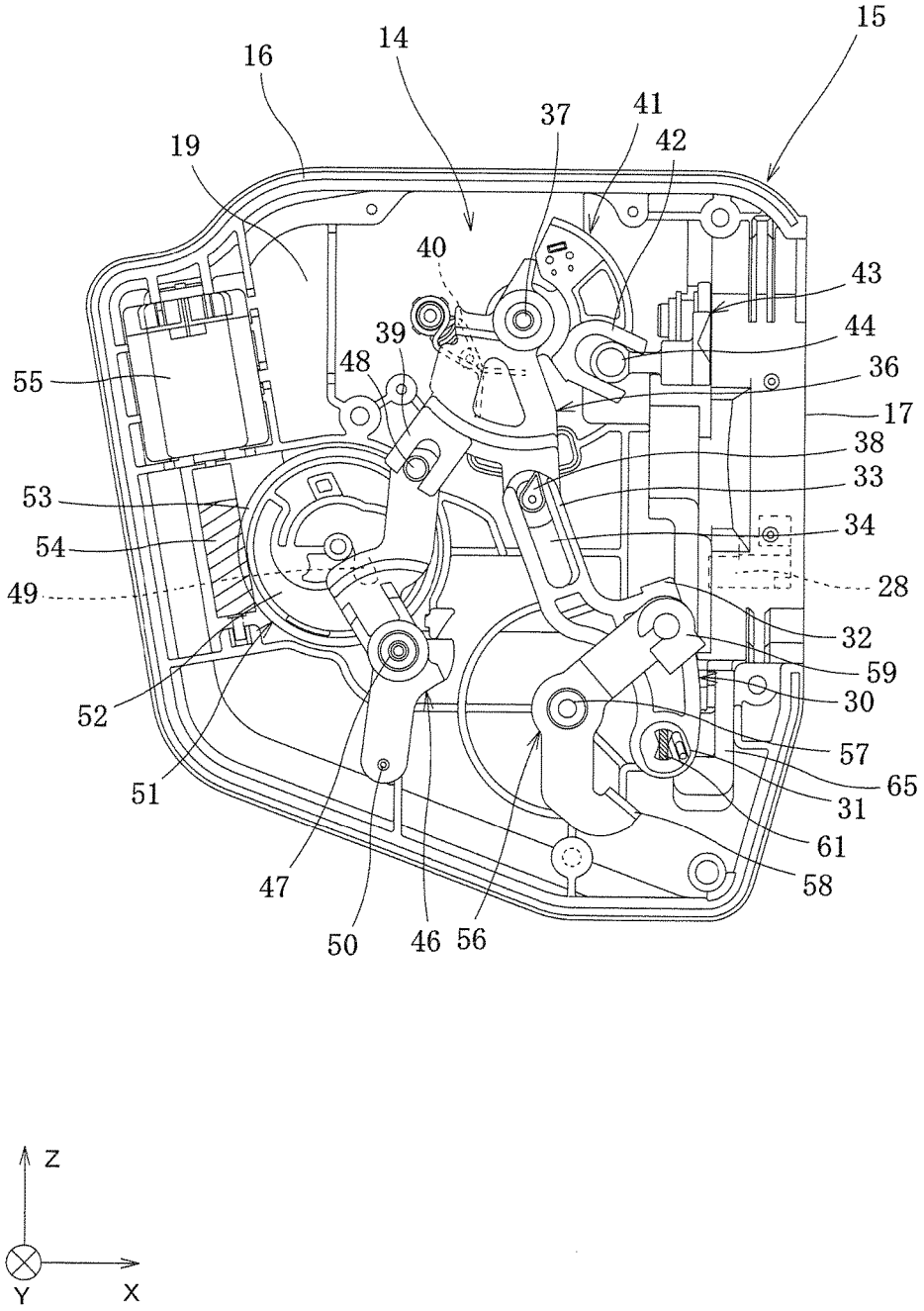
FIG. 5B is a front view of the lock mechanism in a lock state.

As shown in FIGS. 5A and 5B, in the main case 15 included in the lock mechanism 14, a link 30, a lock plate 36, a key lever 41, a knob lever 46 and a cam member 51 are disposed in the first case part 16 serving as the component housing part 19. The link 30 is placed on the second case part 17 side (on the right side in the figure) on which the latch mechanism 11 is mounted. The lock plate 36 is placed on the upper side of the link 30. The key lever 41 is placed so as to be positioned beside the lock plate 36. The knob lever 46 is placed so as to be positioned on the lower side of the lock plate 36 and on the left side of the link 30. The cam member 51 is placed so as to be positioned on the upper left side of the knob lever 46.

The link 30 includes a passive part 31 positioned at a lower end in the figure, and a first coupling part 33 positioned at an upper end in the figure. The passive part 31 is positioned downward of the operation receiving part 28 of the claw 25 protruding into the component housing part 19. In the unlock state shown in FIG. 5A, an upper portion of the passive part 31 is provided so as to extend toward the operation receiving part 28, where an operation part 32 is provided at an upper end of the passive part 31. The first coupling part 33 is provided so as to extend left-side upward from the operation part 32 as in the figure. The first coupling part 33 is provided with a coupling recess 34 extending in an up/down direction as in the figure. By a kick spring 35 (see FIG. 3) which is placed on a later-described bearing part 70, the link 30 is elastically biased in such a direction that the operation part 32 is separated apart from the operation receiving part 28 (i.e., a downward direction in the figure).

In the link 30, the passive part 31 is rotatably supported by a later-described outer lever 60, and the first coupling part 33 is supported by the lock plate 36 so as to be rotatable and linearly movable. As a result, the first coupling part 33 side of the link 30 is rotatable left-and-right in the figure around the passive part 31. Further, when pushed upward by an inner lever 56 or outer lever 60, the link 30 can be linearly moved up and down along the extending direction of the coupling recess 34. When the link 30 is moved upward in the unlock state shown in FIG. 5A, the operation part 32 is engageable with the operation receiving part 28 so that the operation receiving part 28 can be moved upward. When the link 30 is moved upward in the lock state shown in FIG. 5B, the operation part 32 is non-engageable with the operation receiving part 28 so that the operation receiving part 28 cannot be moved upward, resulting in an idling.

The lock plate 36 is rotatably supported by a lock plate rotating shaft 37. In the lock plate 36, a link coupling part 38 is provided on the lower right side of the lock plate rotating shaft 37, and a knob lever coupling part 39 is provided on the lower left side of the lock plate rotating shaft 37. The lock plate 36 is rotatable between an unlock position, in which the link coupling part 38 has neared the operation receiving part 28 as shown in FIG. 5A, and a lock position, in which the link coupling part 38 is apart from the operation receiving part 28 as shown in FIG. 5B. The rotational angle position of the lock plate 36 around the lock plate rotating shaft 37 is set to the unlock position or the lock position by an action spring 40. As the lock plate 36 is pressed clockwise (lock-actuated) in the unlock state, the link 30 can be rotated to the lock position. As the lock plate 36 is pressed counterclockwise (unlock-actuated) in the lock state, the link 30 can be rotated to the unlock position.

The key lever 41 is rotatably supported by the lock plate rotating shaft 37. The key lever 41 is provided with a coupling receiving part 42, and a lever coupling part 44 of a key shaft 43 is coupled to the coupling receiving part 42. As shown in FIG. 3, the key shaft 43 is placed on the inner surface side of the second case part 17, on which the latch mechanism 11 is to be mounted. A key coupling member 45 is placed on the outer surface side of the second case part 17. The key coupling member 45 is coupled, on its one end side, to the key shaft 43 and, on the other end side, to a key cylinder via a rod as an example. As shown in FIGS. 5A and 5B, when the key cylinder is operated for locking, the key shaft 43 is rotated so that the lever coupling part 44 is moved downward via the key coupling member 45. Then, the key lever 41 presses the lock plate 36 clockwise, causing the lock plate 36 to be lock-actuated. As shown in FIGS. 5B and 5A, when the key cylinder is operated for unlocking, the key shaft 43 is rotated so that the lever coupling part 44 is moved upward via the key coupling member 45. Then, the key lever 41 presses the lock plate 36 counterclockwise, causing the lock plate 36 to be unlock-actuated.

The knob lever 46 is rotatably supported by a knob lever rotating shaft 47. In the knob lever 46, a second coupling part 48 to be coupled to the knob lever coupling part 39 of the lock plate 36 is provided so as to extend upward from the knob lever rotating shaft 47. The second coupling part 48 is provided with a cam receiving part 49 protruding toward the rear face side (in the Y direction) as in the figure. The knob lever 46 has a lock knob connecting part 50 provided so as to extend downward from the knob lever rotating shaft 47. The lock knob connecting part 50 is protruded outward from the cover 18 and connected to the vehicle interior-side lock knob via a rod as an example. When the lock knob is operated for locking, the knob lever 46 rotates the lock plate 36 clockwise, causing the lock plate 36 to be lock-actuated as shown in FIGS. 5A and 5B. When the lock knob is operated for unlocking, the knob lever 46 rotates the lock plate 36 counterclockwise, causing the lock plate 36 to be unlock-actuated as shown in FIGS. 5B and 5A.

The cam member 51 is placed so as to be rotatable relative to the first case part 16 and positioned on the rear face side of the second coupling part 48 of the knob lever 46. A front face of the cam member 51 is provided with a cam recess 52 in which the cam receiving part 49 protruding from the knob lever 46 is inserted and placed. The cam member 51 is elastically biased by a spring (not shown) so that its rotational angle position about the rotating shaft comes to a neutral position shown in FIGS. 5A and 5B. A worm wheel part 53 is provided on the outer periphery of the cam member 51. A worm 54 to be meshed with the worm wheel part 53 is placed on the left side of the cam member 51. The worm 54 is rotated forwardly and reversely by the motor 55 placed upward. When a lock switch or remote control is operated for locking, the cam member 51 is rotated clockwise by the motor 55 as shown in FIGS. 5A and 5B. As a result of this, the lock plate 36 is lock-actuated via the knob lever 46. When the lock switch or remote control is operated for unlocking, the cam member 51 is rotated counterclockwise by the motor 55 as shown in FIGS. 5B and 5A. As a result of this, the lock plate 36 is unlock-actuated via the knob lever 46.

(Opening Mechanism)

Figure 6:
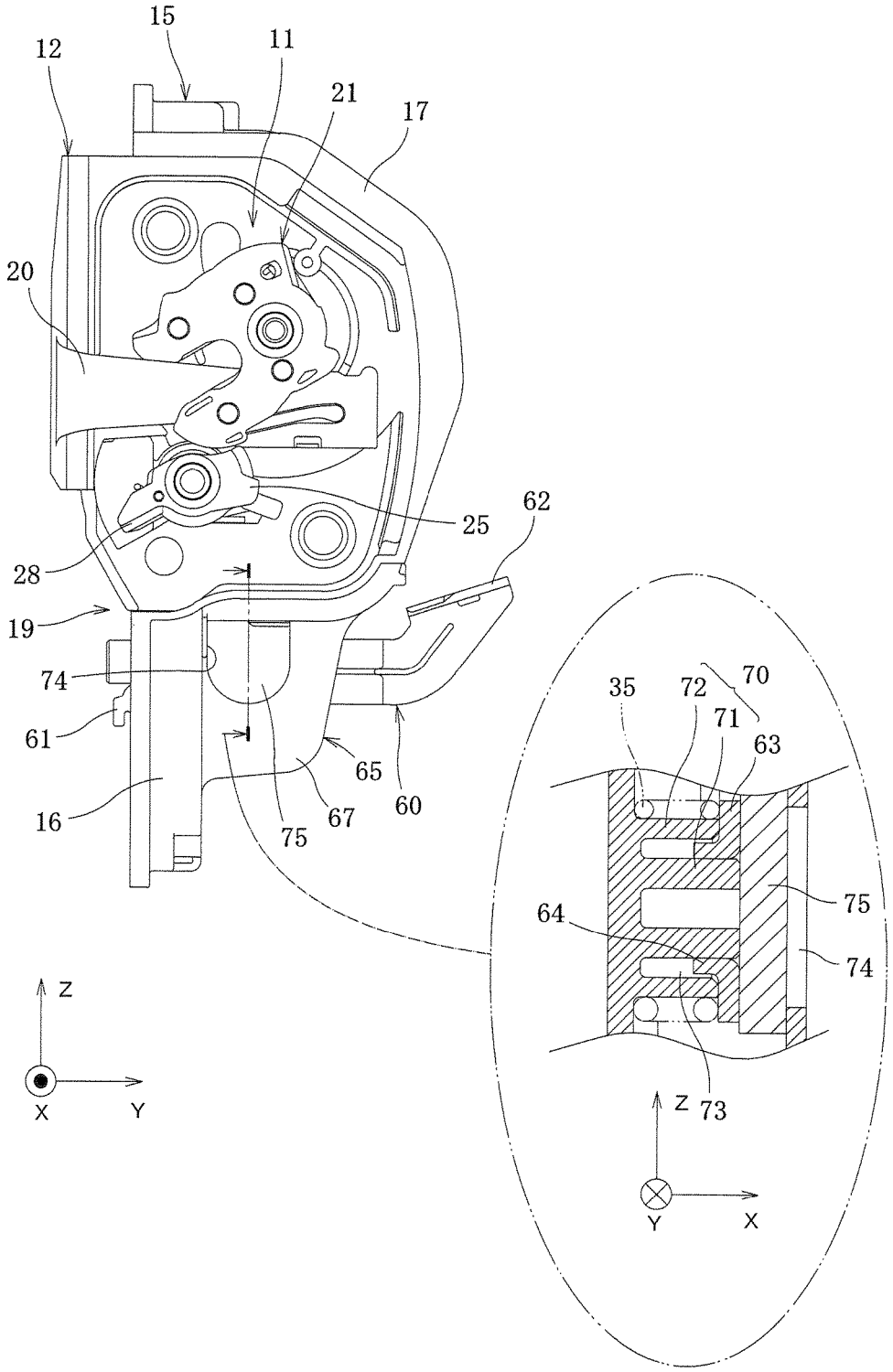
FIG. 6 is a side view of the door lock device according to the embodiment of the present invention.

The main case 15 includes the inner lever 56 connected to the inner handle, and the outer lever (push lever) 60 connected to the outer handle. As shown in FIGS. 5A and 5B, the inner lever 56 is placed between the link 30 and the knob lever 46 in the first case part 16 serving as the component housing part 19. As shown in FIGS. 2 and 6, one end side of the outer lever 60 is positioned within the component housing part 19 and the other end side of the outer lever 60 is placed so as to extend through the wall of the first case part 16 and protrude outward from the first case part 16.

As shown in FIGS. 5A and 5B, the inner lever 56 is rotatably supported by an inner lever rotating shaft 57. A contact portion 58 which extends downward from the inner lever rotating shaft 57 so as to form a J-like shape and which is rotated to be brought into contact with the passive part 31 of the link 30 is provided in the inner lever 56. Further, an inner handle connecting part 59 extends upward from the inner lever rotating shaft 57. The inner handle connecting part 59 is protruded outward from the cover 18 and connected to the inner handle placed on the vehicle interior side of the door 1 via a rod as an example. When the door 1 is operated for opening by the inner handle, the inner lever 56 is rotated counterclockwise, so that the contact portion 58 is brought into contact with the passive part 31, causing the link 30 to be moved upward. Then, in the case where the link 30 is in the unlock position, the engagement of the striker by the latch mechanism 11 is released.

As shown in FIGS. 2 and 6, the outer lever 60 is rotatably supported by the main case 15. In the outer lever 60, a link engaging part 61 is provided on one end side of the outer lever 60 that is placed within the component housing part 19. As most clearly shown in FIGS. 5A and 5B, the link engaging part 61 is engaged with the passive part 31 of the link 30 within the component housing part 19. The outer lever 60 has an outer handle connecting part 62 provided on the other end side that is placed outside the first case part 16. The outer handle connecting part 62 is connected to the outer handle placed on the vehicle exterior side of the door 1 via a rod as an example. When the door 1 is operated for opening by the outer handle, the outer lever 60 is rotated clockwise as in FIG. 6, causing the link 30 to be moved upward. Then, in the case where the link 30 is in the unlock position, the engagement of the striker by the latch mechanism 11 is released.

(Assembling Structure of Outer Lever)

As shown in FIGS. 2 and 6, the outer lever 60 is placed along the YZ plane through a communicating part 65 formed in the main case 15. A bearing part 70 is integrally formed in this communicating part 65, and the outer lever 60 is rotatably supported by the bearing part 70. Further, a restricting member 75 is integrally formed in the sub-case 12 of the latch mechanism 11, and the outer lever 60 is retained by the restricting member 75 so as not to fall off from the communicating part 65.

Figure 7A:
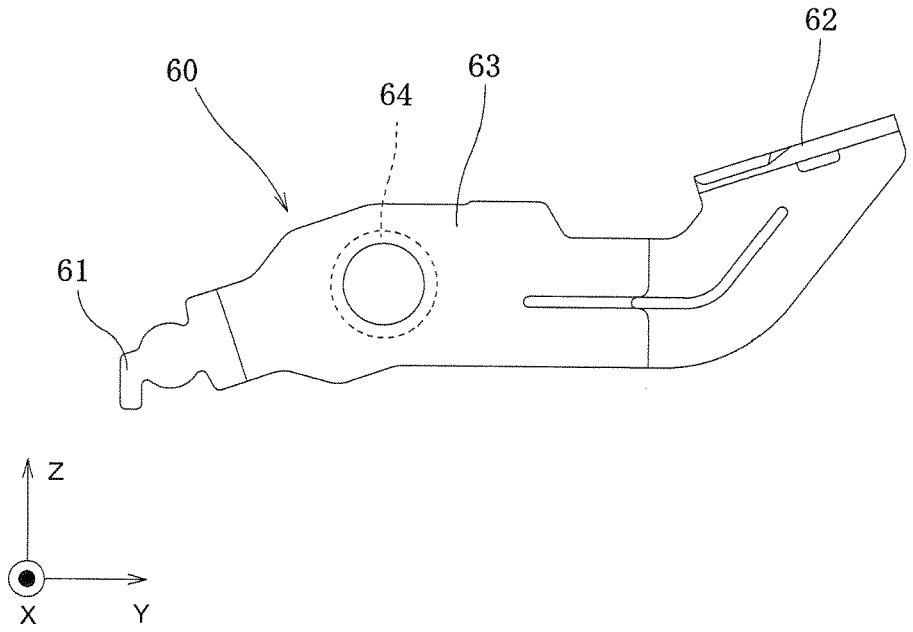
FIG. 7A is a side view of a push lever.
Figure 7B:
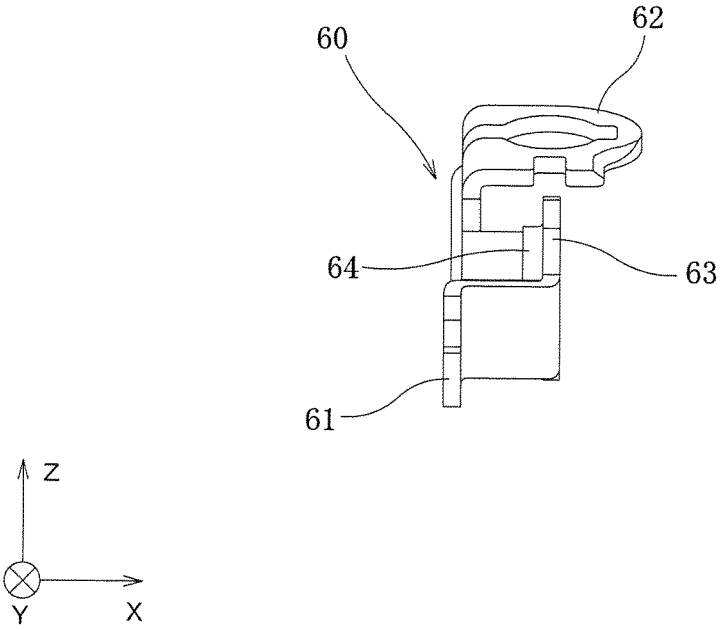
FIG. 7B is a front view of the push lever.
Figure 7C:
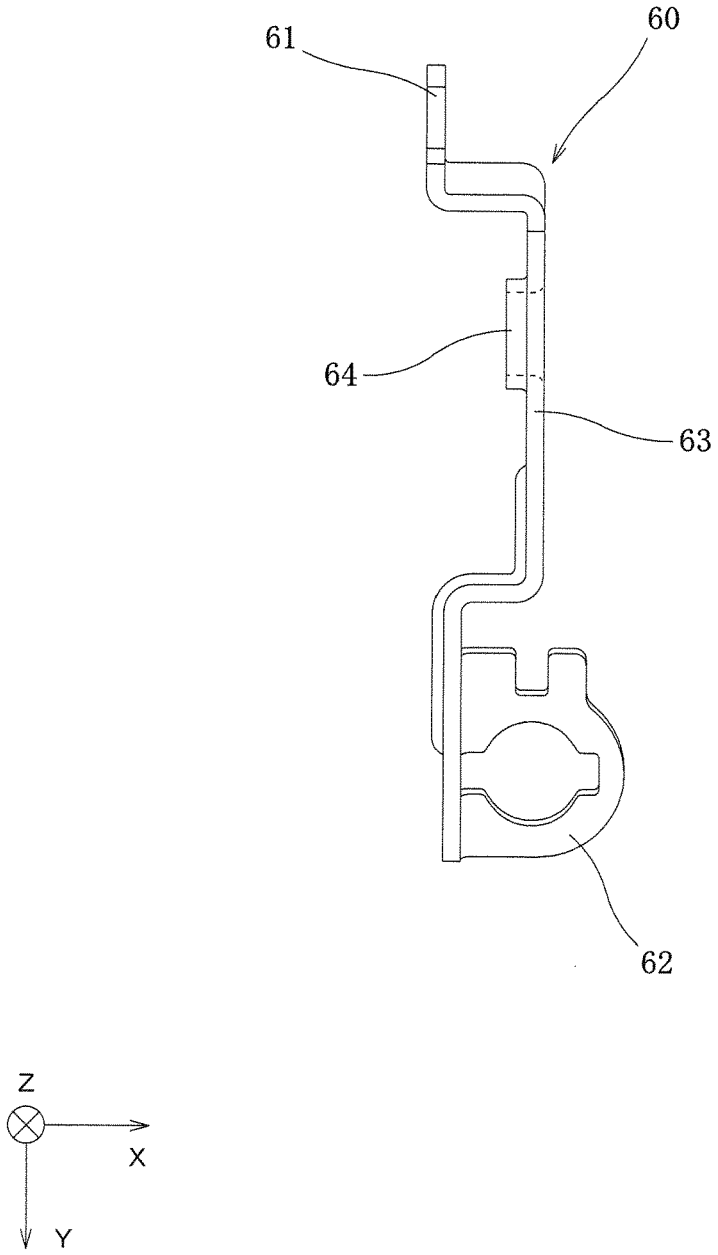
FIG. 7C is a bottom view of the push lever.

As shown in FIGS. 7A, 7B and 7C, the outer lever 60 is provided by bending a metal plate punched into a specified configuration. As most clearly shown in FIG. 7A, the link engaging part 61 is provided on the left-side end portion in the figure, and the outer handle connecting part 62 is provided on the right-side end portion in the figure. As most clearly shown in FIG. 7C, a placement part 63 placed in the communicating part 65 is provided between the link engaging part 61 and the outer handle connecting part 62. The placement part 63 is bent outward in the X direction. In the placement part 63, a shaft part 64 protrudes inward in the X direction. The shaft part 64 in this embodiment is a cylindrical-shaped shaft part integrally formed in the outer lever 60 by burring process. The outer lever 60 is biased counterclockwise, as viewed in FIG. 6, via the link 30 by the kick spring 35 that biases the link 30.

Figure 8:
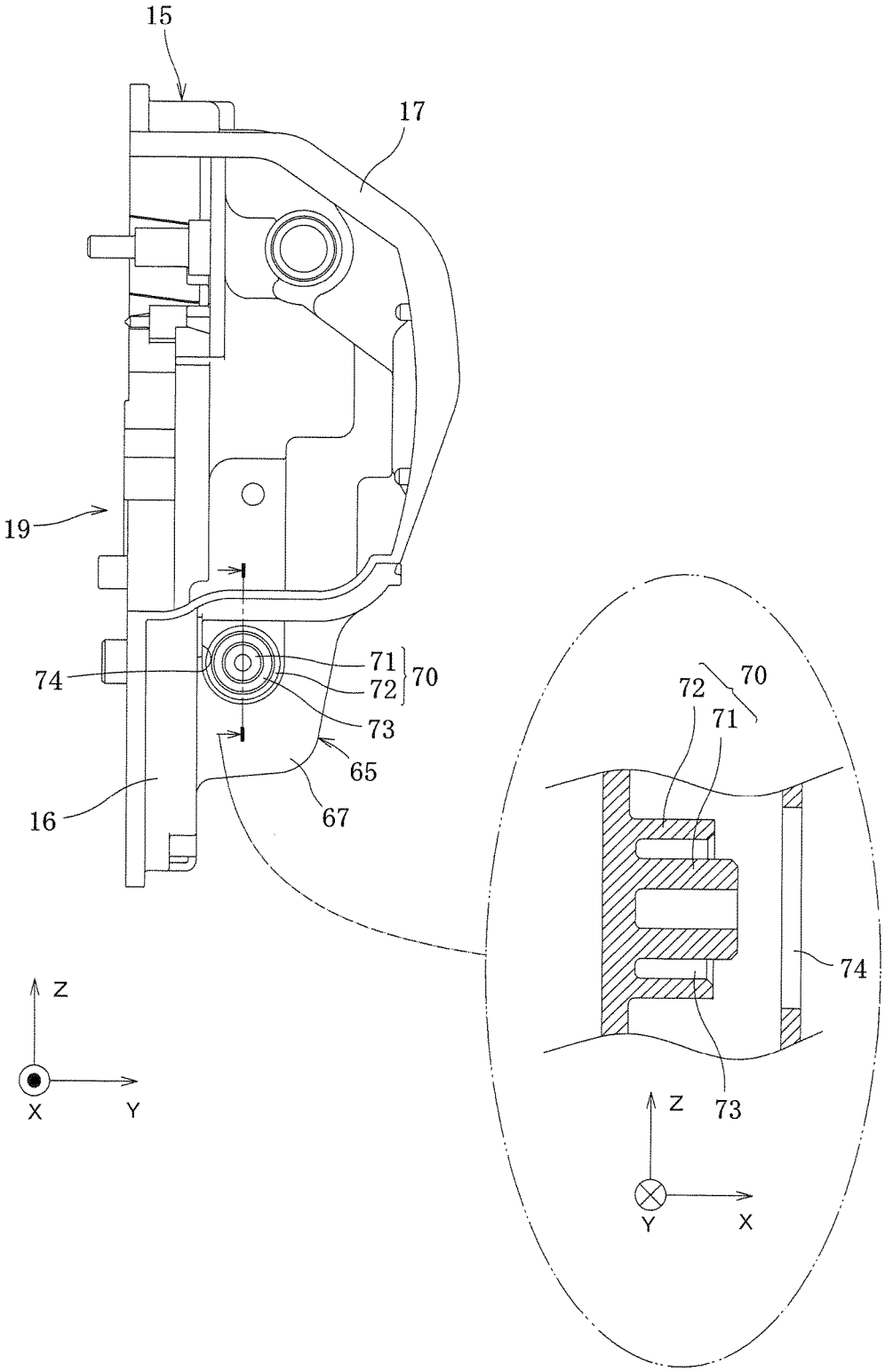
FIG. 8 is a side view of a main case before the push lever is attached thereto.

As shown in FIGS. 2 and 8, the main case 15 is provided with the communicating part 65 through which the outer lever 60 is inserted, and placed, from outside of the first case part 16 into the component housing part 19. In a lower portion of the second case part 17, the communicating part 65 includes a first wall 66 extending in parallel along the YZ plane, and a second wall 67 facing the first wall 66 with a specified distance to the first wall 66 outward in the X direction. A space interposed between these first and second walls 66, 67 defines the communicating part 65. The first wall 66 and the second wall 67 are provided so as to protrude in the Y direction from the first case part 16 extending along the XZ plane. The lower end side of the first wall 66 and the second wall 67 is closed by a continuous wall 68 on the outer side of the first case part 16, and the upper end side of the first wall 66 and the second wall 67 is formed as an insertion part 69 opened within the second case part 17.

The bearing part 70 that rotatably supports the outer lever 60 is integrally formed in the first wall 66. The bearing part 70 includes a cylindrical-shaped inner shaft part 71 protruding toward the second wall 67, and a cylindrical-shaped outer shaft part 72 protruding from outside of the inner shaft part 71 toward the second wall 67. A recessed groove 73 into which the shaft part 64 of the outer lever 60 is to be fitted is formed between the inner shaft part 71 and the outer shaft part 72. In addition, an opening 74 of the second wall 67 is a hole to be used in die cutting for formation of the bearing part 70.

As clearly shown in FIG. 6, a protruding extent of the inner shaft part 71 from the first wall 66 is set longer than a protruding extent of the outer shaft part 72 from the first wall 66 by an extent corresponding to the wall thickness of the outer lever 60, more specifically, an extent corresponding to the thickness of the placement part 63 where the shaft part 64 is provided. As a result of this, when one surface of the placement part 63 is put into contact with a leading end of the outer shaft part 72, a leading end of the inner shaft part 71 and the other surface of the placement part 63 are positioned flush with each other. Further, a gap which is larger than the thickness of the outer lever 60 including the protruding extent of the shaft part 64 and which allows the outer lever 60 to be inserted and placed thereinto is formed between the leading end of the inner shaft part 71 and the second wall 67.

As shown in FIGS. 2 and 6, a restricting member 75 is provided in the sub-case 12 of the latch mechanism 11 in order to close a gap between the outer lever 60 and the communicating part 65. As most clearly shown in FIG. 3, the restricting member 75 is provided so as to protrude from the inner surface side of the sub-case 12 and extend downward in an arm shape as in the figure. The wall thickness of the restricting member 75 is set to a size corresponding to the gap between the leading end of the inner shaft part 71 and the second wall 67. The restricting member 75 is placed in the communicating part 65 of the main case 15 through the insertion part 69 so as to be positioned in contact with the inner shaft part 71 and the second wall 67. As a result, as shown in FIG. 6, the shaft part 64 of the outer lever 60 is retained between the restricting member 75 and the bearing part 70. That is, the shaft part 64 of the outer lever 60 supported by the bearing part 70 is retained between the first wall 66 and the second wall 67 via the restricting member 75. Further, the opening 74 of the second wall 67 is closed by the restricting member 75.

(Assembling Work)

Figure 9:
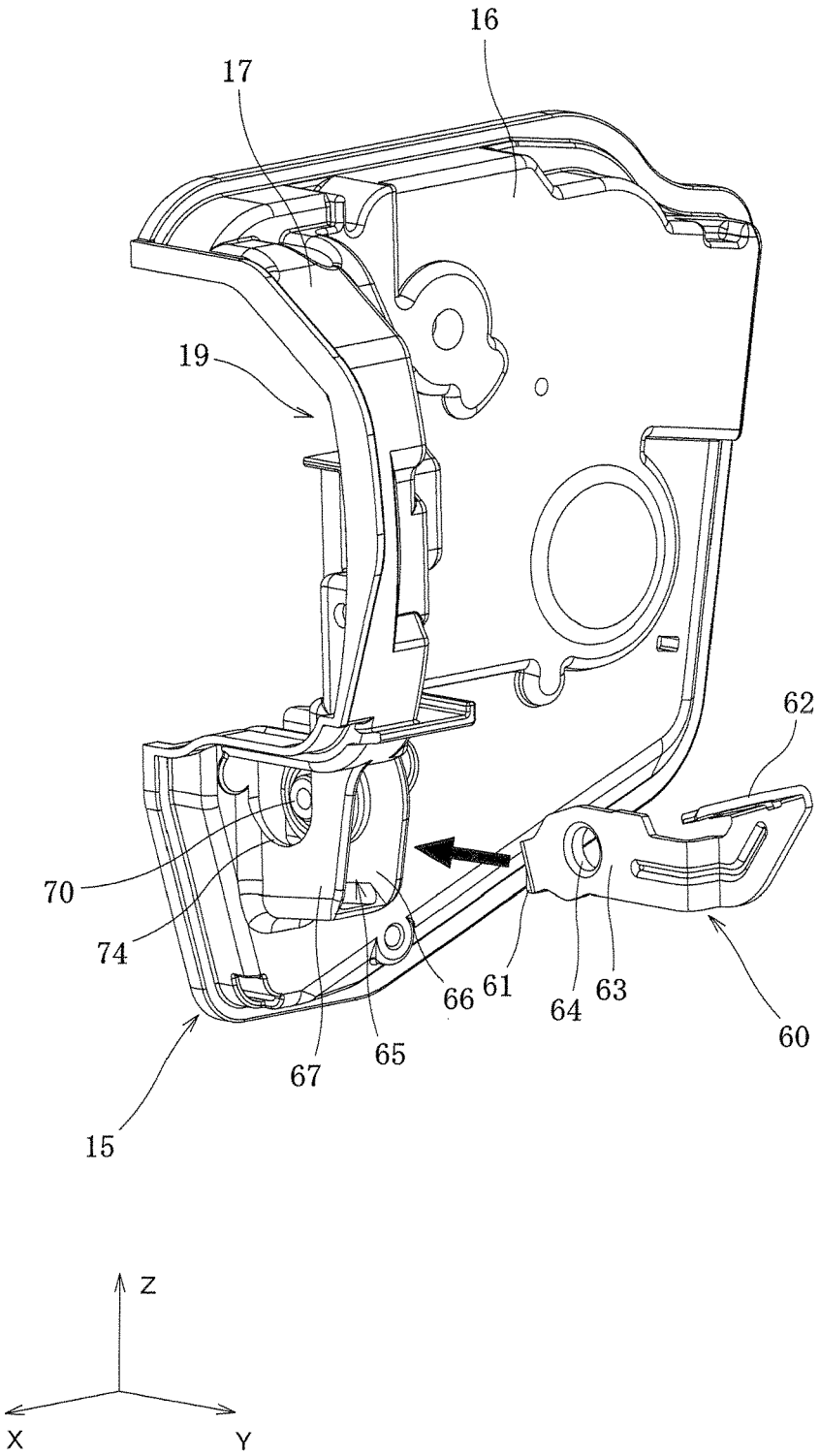
FIG. 9 is a perspective view of the main case when the push lever is attached thereto.
Figure 10:
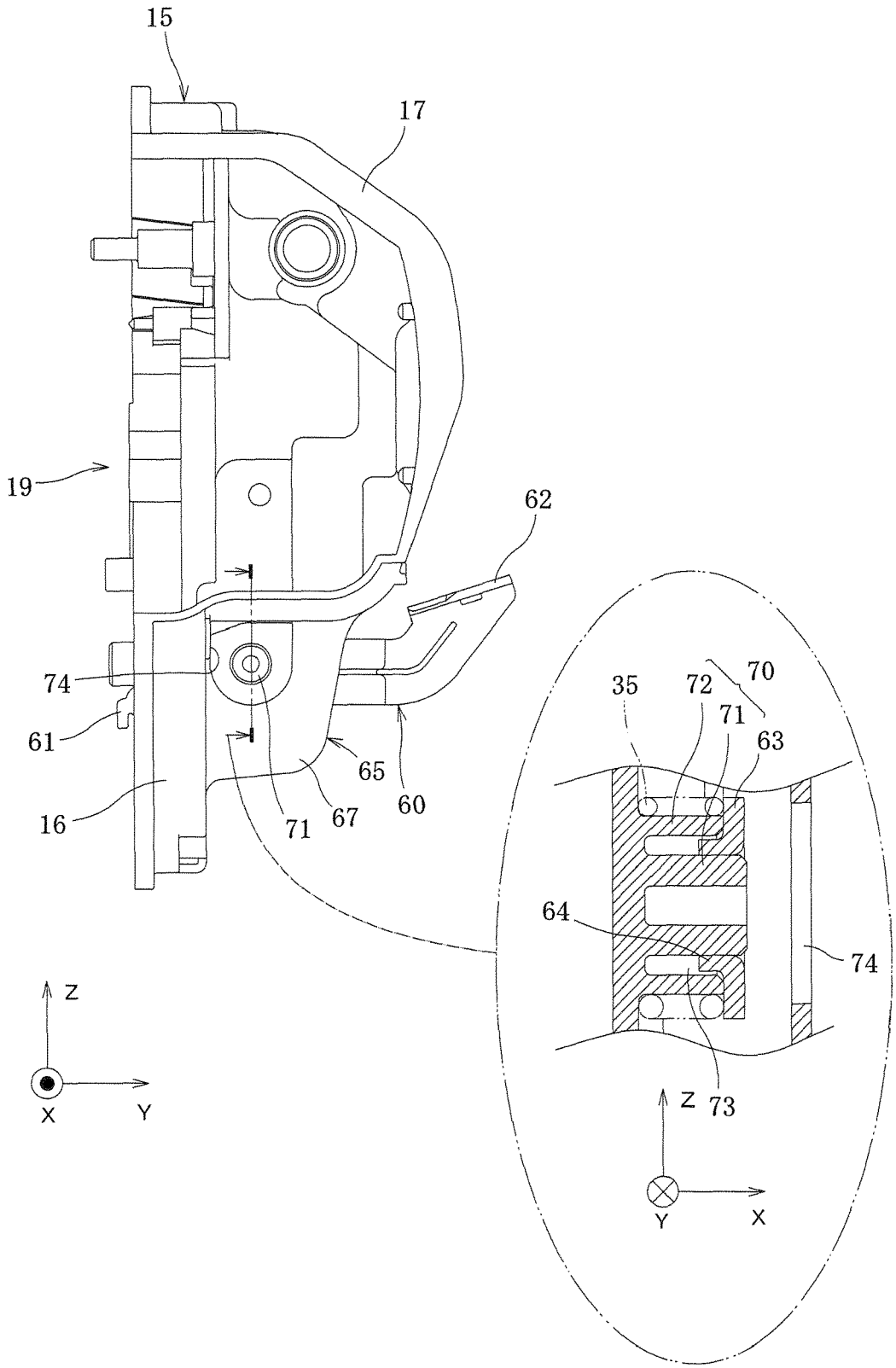
FIG. 10 is a perspective view of the main case after the push lever is attached thereto.

In assembling of the outer lever 60 to the main case 15, first, the kick spring 35 is set in the communicating part 65 of the main case 15 and then fitted to the outer periphery of the outer shaft part 72 of the bearing part 70. Then, as shown in FIG. 9, the outer lever 60 is set outside the communicating part 65 of the main case 15 and inserted thereinto from the link engaging part 61 side. Then, as shown in FIG. 10, while the shaft part 64 of the outer lever 60 is set in correspondence to the bearing part 70 within the communicating part 65, the shaft part 64 is fitted into the recessed groove 73.

Figure 11:
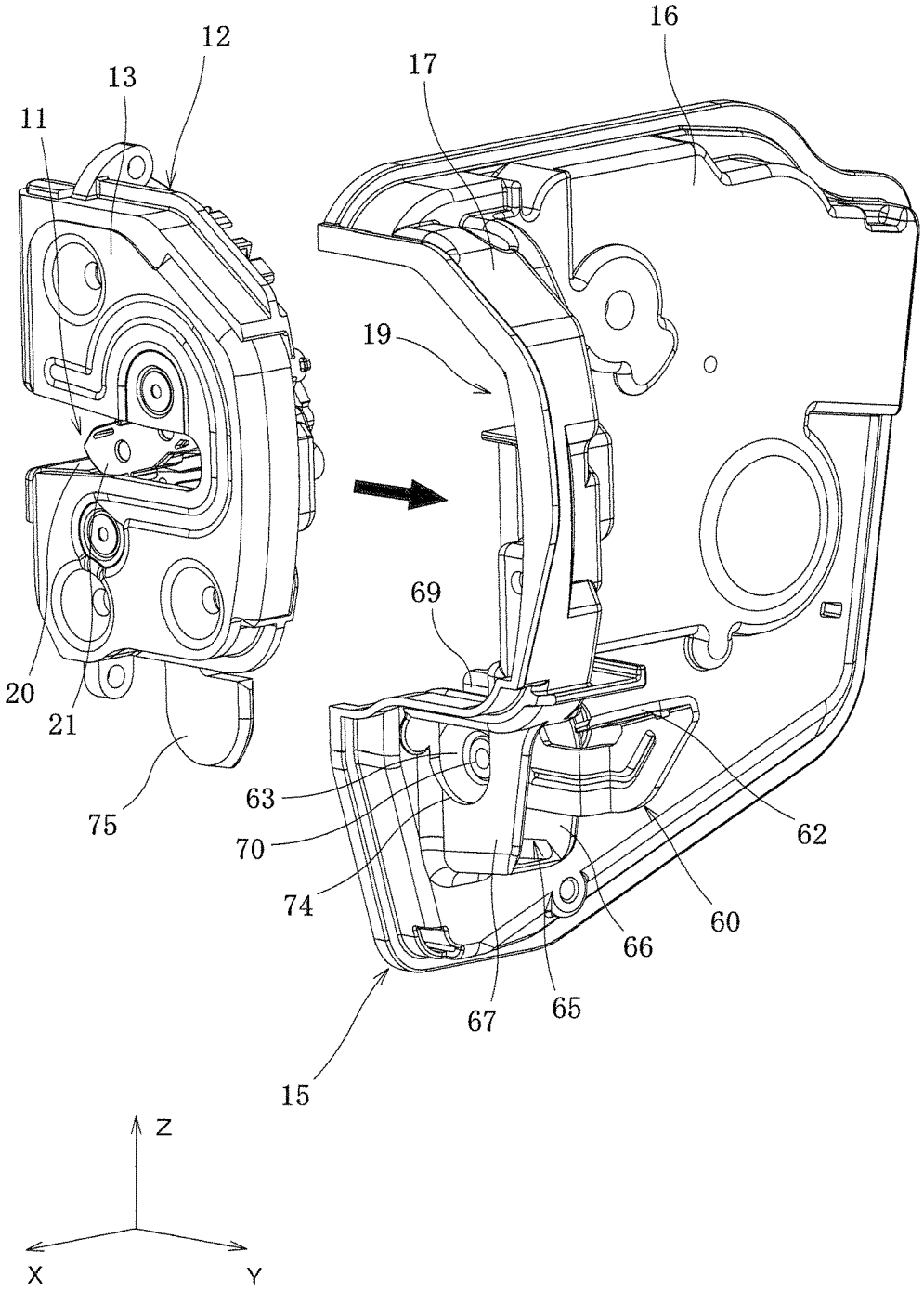
FIG. 11 is a perspective view of the main case when the latch mechanism is attached thereto.

Next, as shown in FIG. 11, the latch mechanism 11 is set on the opening side of the first case part 16 of the main case 15 and attached to the second case part 17. In this process, the restricting member 75 is set to within the communicating part 65 through the insertion part 69 and positioned between the outer lever 60 and the second wall 67. As a result, as shown in FIGS. 1 and 6, the outer lever 60 can be rotatably supported relative to the main case 15.

After the outer lever 60 and the latch mechanism 11 have been assembled to the main case 15 in this way, various components including the link 30 and the lock plate 36 of the lock mechanism 14 are subsequently assembled to the first case part 16 in the same manner as in conventional cases and then the cover 18 is attached to the first case part 16. Thereafter, in the assembling to the door 1 of the vehicle, the key coupling member 45 is coupled to the key cylinder, the knob lever 46 is coupled to the lock knob, the inner lever 56 is coupled to the inner handle, and the outer lever 60 is assembled to the outer handle.

As described above, in the door lock device 10 of the invention, the shaft part 64 of the outer lever 60 is rotatably supported by the bearing part 70 that is integrally formed in the main case 15. Accordingly, there is no need for providing a shaft independent of the main case 15 to rotatably support the outer lever 60. Thus, a number of parts can be reduced, so that the device structure can be simplified.

Further, since the shaft part 64 of the outer lever 60 is retained between the bearing part 70 and the restricting member 75, the work of shaft caulking process or the like is not necessitated, so that the assembling man-hours can be reduced and the assembling work can be simplified. Furthermore, since the restricting member 75 is integrally formed in the latch mechanism 11, the shaft part 64 of the outer lever 60 can be retained between the first wall 66 and the second wall 67 via the restricting member 75 simultaneously while the latch mechanism 11 is attached to the main case 15. Thus, the assembling man-hours can be reduced.

Since the shaft part 64 of the outer lever 60 is formed into a cylindrical shape and the bearing part 70 of the main case 15 is formed into a double-cylindrical structure having the recessed groove 73 and the shaft part 64 is fitted into the recessed groove 73 so as to be rotatably supported, it follows that the outer lever 60 can be rotated smoothly and stably. Still more, the cylindrical-shaped shaft part 64, which is formed by burring process, can easily be formed integrally with the outer lever 60.

Further, the protruding extent of the inner shaft part 71 is set longer than the protruding extent of the outer shaft part 72 by an extent corresponding to the thickness of the part where the shaft part 64 is formed. Accordingly, the shaft part 64 of the outer lever 60 can be pinched at its periphery and retained between the outer shaft part 72 and the restricting member 75, and thereby the leading end of the inner shaft part 71 can be put into direct contact with the restricting member 75. Thus, the restricting member 75 can be prevented from being brought into pressure contact against the outer lever 60 with excessively strong force, so that actuation of the outer lever 60 can be stabilized.

The door lock device 10 of the invention is not limited to the structure of the above-described embodiment, and may be changed in various ways.

For example, the bearing part 70 of the main case 15 is provided in a double-cylindrical structure having the inner shaft part 71 and the outer shaft part 72, and a step gap is formed between the shaft parts 71, 72 in the above-described embodiment. However, the shaft parts may also be formed with an equal protruding extent so that no step gap is formed and, what is more, a single cylindrical-shaped or columnar-shaped shaft part will do as well. Further, although the restricting member 75 for retaining the shaft part 64 of the outer lever 60 is integrally formed in the sub-case 12 of the latch mechanism 11, yet the restricting member 75 may be formed independently as an exclusive component. Further, the communicating part 65 that allows the outer lever 60 to be inserted therethrough may also be changed in makeup as desired. Besides, although the assembling structure of the push lever in this invention has been described on an exemplary case of the outer lever 60 that is connected to the outer handle in the above embodiment, yet the inner lever 56 to be connected to the inner handle may instead be provided in a similar assembling structure.

What is claimed is:

1. A door lock device comprising:

a latch mechanism releasably engaged with a striker and having an operation receiving part for releasing engagement of the striker;

a link movable between an unlock position and a lock position, the unlock position allowing the link to engage with the operation receiving part of the latch mechanism so that the engagement of the striker is able to be released, and the lock position not allowing the link to engage with the operation receiving part of the latch mechanism so that the engagement of the striker is not able to be released;

a lock plate for positioning the link into the unlock position or the lock position;

a push lever having a shaft part, coupled to a door handle provided on a door, and configure to operate, upon operation of the door handle, so as to release engagement of the striker by the latch mechanism via the link positioned in the unlock position and the operation receiving part;

a main case in which a bearing part for rotatably supporting the shaft part of the push lever is formed integrally therewith; and a restricting member in contact with the main case, wherein the shaft part of the push lever is retained between the bearing part and the restricting member, wherein the latch mechanism is attached to the main case, wherein the restricting member is integrally formed in a sub-case of the latch mechanism so as to extend in an arm shape, wherein the main case includes a first wall with the bearing part formed thereon, a second wall opposed to the first wall, and a communicating part defined between the first wall and the second wall, the communicating part being communicated with a component housing part in which the link is arranged so as to allow the push lever to be inserted into the component housing part, and wherein the shaft part of the push lever supported by the bearing part is retained between the first wall and the second wall via the restricting member.

2. The door lock device according to claim 1, wherein the bearing part of the main case includes a cylindrical-shaped inner shaft part protruding toward the second wall, and a cylindrical-shaped outer shaft part placed outside the inner shaft part and protruding toward the second wall, wherein a recessed groove is formed between the inner shaft part and the outer shaft part, and wherein the shaft part of the push lever is a cylindrical-shaped shaft part to be fitted into the recessed groove.

3. The door lock device according to claim 2, wherein the cylindrical-shaped shaft part is formed integrally with the push lever by burring process.

4. The door lock device according to claim 2, wherein a protruding extent of the inner shaft part from the first wall is longer than a protruding extent of the outer shaft part from the first wall by an extent corresponding to a thickness of a portion of the push lever where the cylindrical-shaped shaft part is provided.

5. The door lock device according to claim 2, wherein the shaft part of the push lever is inserted to an insertion portion between upper ends of the first and second walls, and is held between the first and second walls through the restricting member.

* * * * *